US005941323A

United States Patent [19]

Warren

[11] Patent Number: 5,941,323

[45] Date of Patent: Aug. 24, 1999

[54] STEERABLE DIRECTIONAL DRILLING TOOL

[75] Inventor: Tommy M. Warren, Coweta, Okla.

[73] Assignee: BP Amoco Corporation, Chicago, Ill.

[21] Appl. No.: 08/935,419

[22] Filed: Sep. 23, 1997

Related U.S. Application Data

[60] Provisional application No. 60/026,757, Sep. 26, 1996.

[51] Int. Cl.[6] ..... E21B 7/08

[52] U.S. Cl. ..... 175/74; 175/75

[58] Field of Search ..... 175/75, 61, 45, 175/73, 76, 74, 273; 166/117.6

[56] References Cited

U.S. PATENT DOCUMENTS

| | | | |
|---|---|---|---|
| 4,394,881 | 7/1983 | Shirley | 175/76 |
| 5,181,576 | 1/1993 | Askew et al. | 175/61 |
| 5,259,467 | 11/1993 | Schoeffler | 175/38 |
| 5,421,421 | 6/1995 | Appleton | 175/76 |
| 5,467,834 | 11/1995 | Hughes et al. | 175/61 |
| 5,553,679 | 9/1996 | Thorp | 175/73 |
| 5,836,406 | 11/1998 | Schuh | 175/61 |

*Primary Examiner*—Frank Tsay
*Attorney, Agent, or Firm*—James A. Gabala; Robert E. Sloat

[57] ABSTRACT

A drilling tool for use with a drill string into which drilling fluid is pumped. The tool comprises: a non-rotating housing having stabilizer blades on its outer surface; a rotating mandrel, passing through the housing; extendible blade means for moving the housing relative to a borehole; and a cam mechanism that is carried by at least one of the mandrel and the housing, and that is operated by drill string rotation and the flow of drilling fluid for operating the extendible blade means to move the drill string and steer the drill bit attached hereto.

28 Claims, 3 Drawing Sheets

STEERABLE DIRECTIONAL DRILLING TOOL

RELATED APPLICATION

This patent application relates to a provisional patent application having a serial number of 60/026,757 and having a filing date of Sep. 26, 1996.

TECHNICAL FIELD

This invention relates to the general subject of oil well and gas well drilling and, in particular, to apparatus and methods used to drill a curved wellbore through the surface of the earth.

BACKGROUND OF THE INVENTION

In the petroleum industry it is often advantageous to drill boreholes along non-vertical, directional paths in order to optimally produce hydrocarbons. These directional paths, composed of a set of "curved" segments and "straight" segments, are most often drilled with a drilling assembly where the drill bit is powered by a mud motor. The drilling assembly is composed of a drill bit and mud motor with one or more "bends" immediately above, below, or intermediate the motor. When the bit is being steered in a desired direction, the entire drill string is not rotated in order to maintain the "bends" and the motor directed in the proper orientation.

This type of system has several inherent disadvantages. The mud motor is expensive to manufacture and maintain. It is a failure prone piece of equipment. The non-rotating drill string also causes cuttings to accumulate on the low side of the borehole which may inhibit the removal of the drill string. Non-rotation of the drill string results in high frictional contact between the wellbore wall and the drill string which inhibits the smooth application of an axial force to the drill bit which is needed in order to drill efficiently. In addition, the drill string tends to "stick" in the borehole and does not slide down freely. Moreover, as soon as sufficient force is added to the drill string to cause it to break the static friction and slide, it often slides too rapidly and overpowers the motor. This may cause the motor to stall or to apply too much torque to the drill string so that the desired orientation is lost. Either consequence results in wasted time and money by requiring that the drilling process be restarted. For these reasons it is desirable to continuously rotate the drill string while directing the bit along the desired directional path.

In anticipation of these difficulties and in order to minimize them, many times an "unaggressive" drill bit is used which results in the penetration rate being slower than it would be if the optimum drill bit were used. Again, this results in an inefficient drilling operation.

Because of their high initial manufacturing cost, high maintenance cost, low reliability, and overall drilling inefficiencies when using mud motor systems, it is anticipated that mud motor drilling assemblies for directional work will become obsolete.

There are a number of new rotary steerable systems currently under development. Many of the systems that are receiving the most attention are very sophisticated systems that are also likely to have high initial manufacturing costs and possibly be less reliable than a simple system.

There are also a number of less complicated devices that have been proposed to allow the drill bit to be directed along a curved path while rotating the drill string. Some of these tools, such as that disclosed in U.S. Pat. No. 5,213,168 which is assigned to Amoco Corporation, require that the drill string be withdrawn from the borehole when it is desired to change from drilling along a curved path to drilling along a straight path. This is a relatively expensive and inefficient process. Other devices, such as that illustrated in U.S. Pat. No. 5,265,682 to Russell et al., allow the drilling mode to be shifted from curved to straight without withdrawing the apparatus from the wellbore. These tools are also relatively complicated, expensive, and failure prone. While there are some relatively simple designs, such as that shown in U.S. Pat. No. 4,895,214 to Schoeffler, for shifting the drilling mode from curved to straight, those do not appear to have been reduced to practice or been commercially successful for one reason or another. Thus, there is a continuing need for improvement.

SUMMARY OF THE INVENTION

The invention described herein overcomes the problems inherent to the above described tools by providing a simple and robust shifting mechanism for changing the drilling mode from "straight" to "curved" and vice versa without withdrawing the drilling assembly from the borehole.

In accordance with the present invention, an apparatus and method of using the apparatus are disclosed for orienting the sleeve of a curve drilling system and for shifting modes of operation of a curve drilling system from a steering mode to a straight drilling mode.

The invention comprises a non-rotating housing with a rotating mandrel passing therethrough with a drill bit attached to the down-hole end of the mandrel and a drill string connected to the up-hole end of the mandrel. The outer surface of the housing has at least two fixed stabilizer blades that keep the housing centered in the hole in a plane passing through the centerline of the hole and the stabilizer blades, and has two extendible blades that move the housing in a second plane passing through the centerline of the borehole and normal to the first plane. The two extendible blades are supported on cam surfaces so that at any time one blade is extended the other is retracted, thereby allowing the housing to be moved relative to the centerline of the borehole. The cam surfaces are operated by drill string rotation and a piston powered by the flow of drilling fluid.

The invention has wide use for drilling oil and gas wells. Moreover, the invention is relatively simple and should have a low operating cost and high reliability.

Numerous other advantages and features of the present invention will become readily apparent from the following detailed description of the invention, the embodiments described therein, from the claims, and from the accompanying drawings.

DETAILED DESCRIPTION

Figure 1:
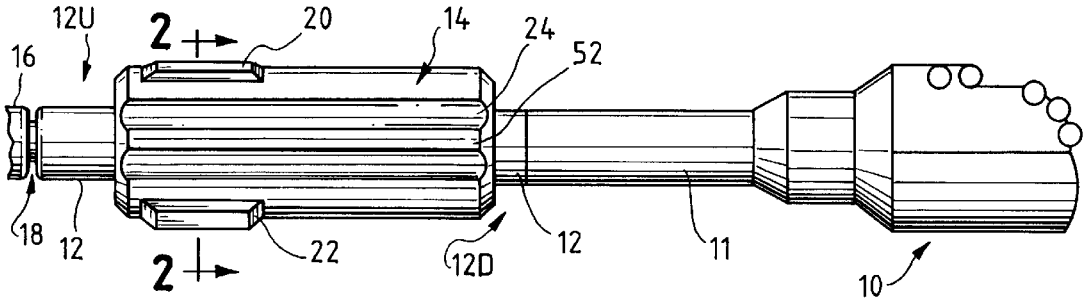
FIG. 1 is a partial, side exterior view of a directional drilling tool that is the subject of the present invention.

While this invention is susceptible of embodiment in many different forms, there is shown in the drawings, and will herein be described in detail, one specific embodiment of the invention. It should be understood, however, the present disclosure is to be considered an exemplification of the principles of the invention and is not intended to limit the invention to the specific embodiment illustrated.

Hardware

Referring to FIG. 1, there is illustrated one embodiment of the invention. In particular, a drill bit 10 is shown connected by an extension sub 11 to a mandrel 12 that passes through a (normally) non-rotating stabilizer housing 14 and that is connected to the remainder of the drill string 16 by a flexible joint 18.

The housing 14 has, at its up-hole end 12U, two active extendible stabilizer pads 20 and 22. The exterior 13 of the housing 14 has one or more longitudinal grooves 24 which define a plurality of fixed or rigid stabilizer blades 50 and 52. The active pads 20 and 22 have the function of changing the position of the centerline 26 of housing 14 relative to the centerline 28 of the borehole 30 (see FIGS. 5A and 5B). The grooves 24 allow circulating mud or drilling fluid to flow from the drill bit 10 to the up-hole end of the borehole.

Figure 2A:
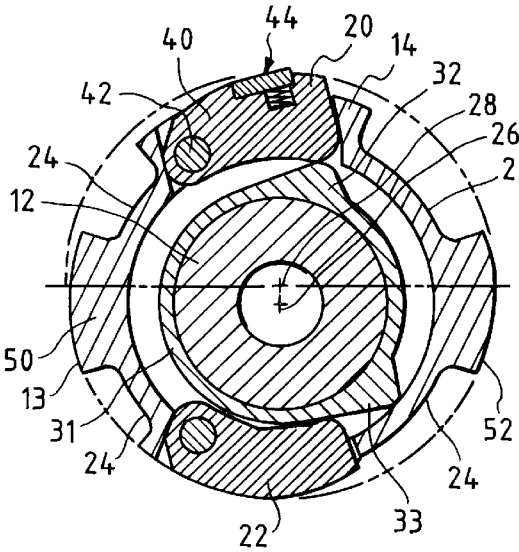
FIGS. 2A and 2B are cross-sectional views through the active pads of FIG. 1.
Figure 2B:
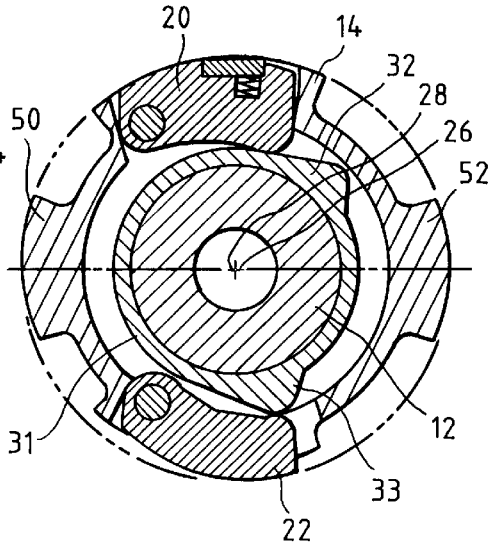

FIG. 2 shows a cross section, as viewed looking down-hole, through the non-rotating housing 14 at the active pads 20 and 22 with the pads positioned for a directional drilling mode (FIG. 2A) and a straight drilling mode (FIG. 2B). The rotating mandrel 12 passes through the center of the housing 14. Surrounding the rotating mandrel 12 is a rotationally adjustable cam sleeve 31. The sleeve is carried by the mandrel and supports two cam surfaces 32 and 33 that are positioned adjacent the two extension pads 20 and 22, such that when one pad is extended the other pad is contracted. The cam sleeve 31 is mounted for rotation through about 30 degrees relative to the bore of the housing 14.

When the cam sleeve 31 is rotated counter-clockwise (see FIG. 2A), the top pad 20 is extended and the bottom pad 22 is retracted. In this position, the centerline 26 of the rotating mandrel 12 is displaced from the centerline 28 of the borehole 30. This is the position of the blades 40 when the drilling tool is used in its "directional drilling mode."

When the cam sleeve 31 is rotated about 30 degrees clockwise (see FIG. 2B) the lower pad 22 is radially extended and the upper pad 20 is retracted. This positions the rotating mandrel 12 at the center of the borehole 30. This is the position of the pads in the "straight drilling mode."

Located to the right and left side of the housing 14 (as viewed in FIGS. 2A and 2B) are a pair of rigid stabilizer blades 50 and 52. These blades are contoured so that they contact the borehole wall in either of the two positions of the two active extension pads 20 and 22. Their function is to prevent the housing 14 from moving laterally and to restrict the motion of the housing to a plane defined by the axis of the housing and the ends of the extendible pads 20 and 22. By rotationally positioning the housing 14 in the borehole, and thus the plane of mandrel displacement, the drill bit 10 can be pointed in any desired direction. Referring to FIG. 2A, each pad 20 and 22 comprises a longitude blade 40 that is pivoted at one long side to the housing 14 by a pivot pin 42. The opposite side is free. As shown in the drawings, the radially extending pad 20 on the top of the tool (see FIG. 2A) may have an additional spring loaded blade 44 that engages the walls of the borehole 30 to prevent clockwise rotation of the housing 14 as the mandrel 12 rotates. The pads (when retracted) are preferably made slightly smaller than the borehole in order to help assure that the housing 14 does not become stuck in the borehole 30. The force from the spring blade 44 also provides a lateral force that forces the housing against the borehole wall.

Figure 3:
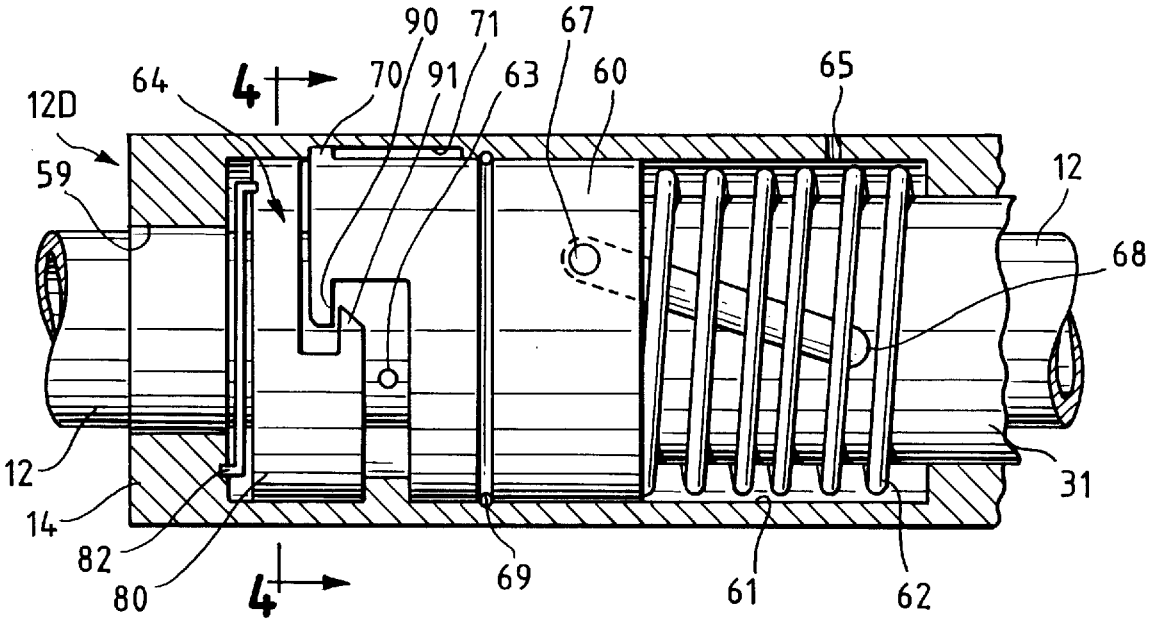
FIG. 3 is a partial, side cross-sectional view of the activation section of FIG. 1.
Figure 5A:
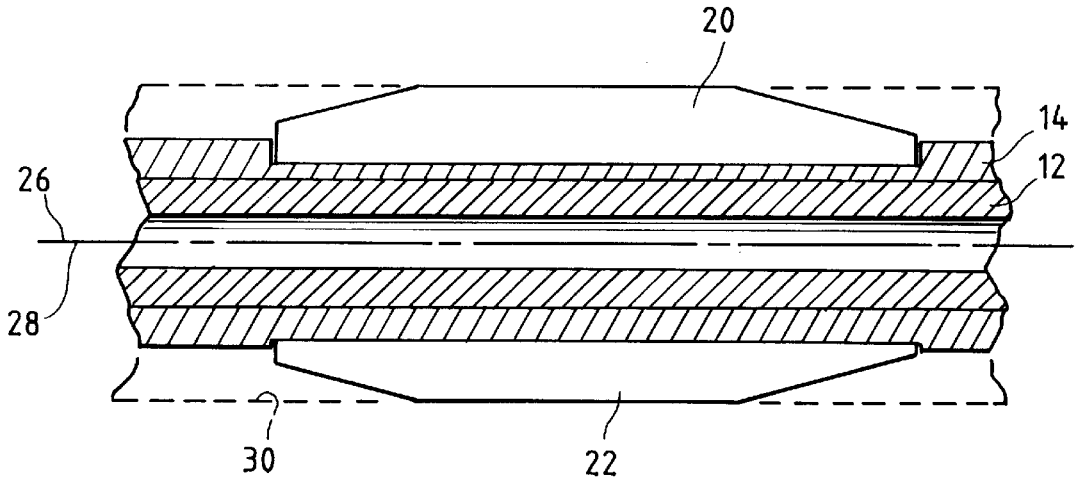
FIG. 5 is a schematic diagram illustrating the effect of movement of the active pads on the position of the drill string.
Figure 5B:
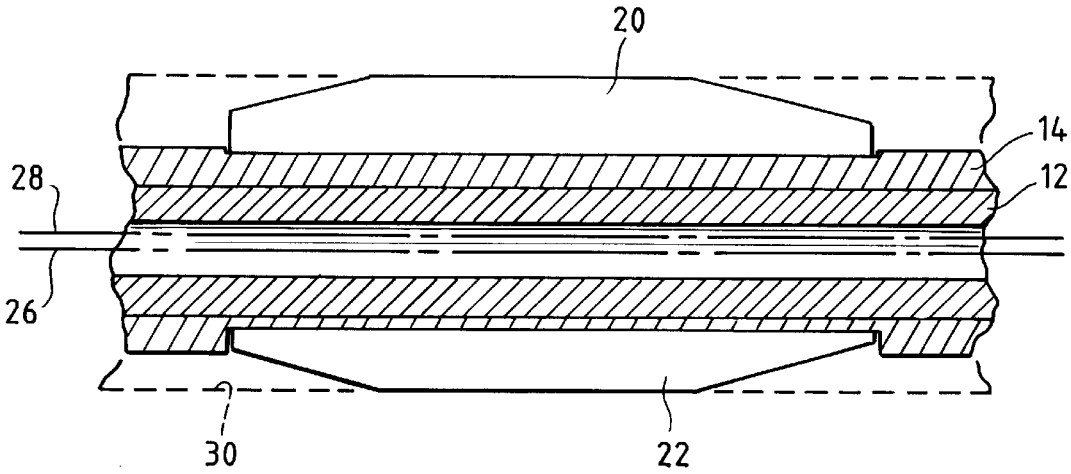

The cam sleeve 31 is operated by a shifter mechanism located at the down-hole end 12D of the housing 14. FIG. 3 shows a longitudinal cross section through the shifter mechanism that is used to rotate the cam sleeve 31 to the desired position. Referring to FIGS. 5A and 5B, when the up-hole end 12U of the mandrel 12 is positioned laterally away (see FIG. 5B) from the center 28 of the borehole 30, the drill bit is tilted and will drill a curved path. When the up-hole end 12U of the mandrel 12 is positioned at the center of the borehole (see FIG. 5A), the drill bit centerline will coincide with the borehole centerline 28 and the drill bit will drill a straight path. In particular, the position of the up-hole end 12U of the rotating mandrel 12 is shifted relative to the centerline 28 of the borehole by adjusting or moving the extension pads 20 and 22 protruding from the non-rotating housing 14. Those skilled in the art know that the length of the extension sub 11 between the drill bit 10 and down-hole end 12D of the mandrel 12 is chosen to cooperate with the magnitude of centerline displacement to provide the desired radius of curvature.

The shifter mechanism comprises an annular piston 60, a return spring 62, and an activation lock 64. The mandrel 14 passes through the down-hole end 12D of the housing 14 (by means of a bushing 59), through the lock 64 and through the piston 60. The spring 62 is located between the interior walls of the housing 14 and the exterior of the cam sleeve 30.

The piston 60 and spring 62 fit within a cylindrical cavity 61 located at the down-hole end 12D of the housing 14. The spring 62 biases the piston 60 toward the down-hole end 12D of the housing 14. An "O-ring" 69 seals the interface between the piston 60 and the cavity 61. A pressure port 63 is located in the mandrel 12 and functions to admit fluid (e.g., drilling mud) within the drill string into the housing cavity 61 to move the piston 60 against the spring 62. A pressure vent or port 65 is located in the housing 14 to discharge fluid from the spring end of the cavity 61 into the exterior of the housing.

The piston 60 is connected to the cam sleeve 31 by means of at least one radially disposed pin 67 that fits within a complimentary angled groove or drive slot 68 that is located on the exterior of the cam sleeve 31. Axial movement of pin 67 in the slot 68 converts linear motion of the piston 60 to rotational motion of the cam sleeve 31. One end of the piston 60 is provided with a tab 70 that fits within a complimentary slot 71 located in the surface of the housing 14. This slot 71 is aligned with the axis of the cavity 61 and keeps the piston 60 from rotating when it is moved axially by the force of the drilling mud.

Figure 4:
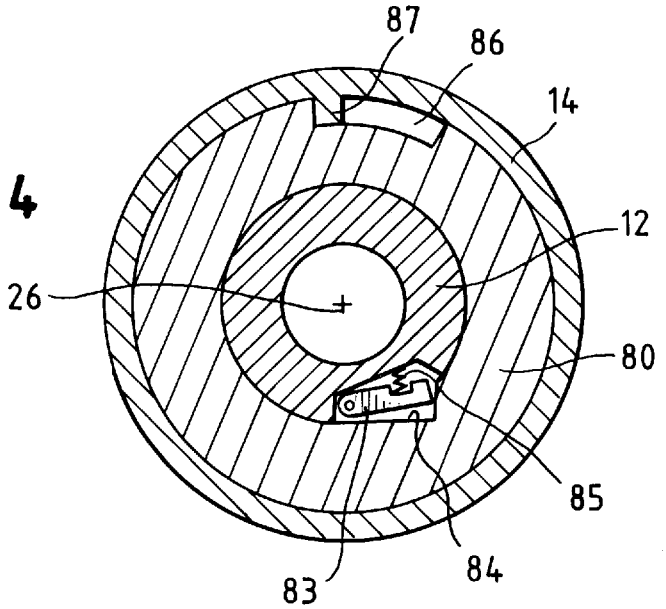
FIG. 4 is a cross-sectional view of the shifter of FIG. 3 as viewed along line 4—4.

The activation lock 64 comprises an annular shaped locking member 80, a torsion spring 82, and an engagement pawl 83 (see FIG. 4). The pawl 83 resides between the exterior of the mandrel 12 and a complimentary recess 84 in the interior of the locking member 80. The pawl 83 has one end pivotally connected to the mandrel 12. The opposite end of the pawl 83 is biased outward by a spring 85 into the recess 84 in the locking member. Thus, counter-clockwise rotation of the mandrel 12 causes the free end of the pawl 83 to engage the locking member 80 and induce counter-clockwise rotation of it. Conversely, clockwise rotation of the mandrel 12 causes the pawl 83 to move inwardly, once it is free of the locking member recess 84. Counter-clockwise rotation of the locking member 80 is limited by a radial slot 86 on the exterior of the member and a complimentary lock stop 87 at the interior of the housing 14. The torsion spring 82 biases the locking member 80 against counter-clockwise rotation.

Undesired axial movement of the piston 60 is limited by means of a pair of complimentary locking tabs 90 and 91 (see FIG. 3). One locking tab 90 is at the down-hole end of the annular piston 60. The other locking tab 91 is located at the up-hole end of the annular locking member 80. As shown in FIG. 3, axial movement of the piston 60 is prevented when the two tabs 90 and 91 overlap one another. The two tabs are unlocked by clockwise rotation of the locking member 80. Once the locking member is returned to the position shown in FIG. 3, the piston 60 is re-engaged or locked at the downhole end of the housing 14 when the biasing spring 62 pushes the piston locking tab 90 atop the other locking tab 91. The up-hole end of this locking tab 91 is "cammed" such that the face of the piston locking tab 90 overcomes the torsional spring 82 and induces rotation of the locking member 80 allowing the two tabs 90 and 91 to resume the positions shown in FIG. 3.

Operation

When it is desired to shift from the straight drilling mode (see FIGS. 2B and 5A) to the directional drilling mode (see FIGS. 2A and 5B), the drill string is rotated counter-clockwise. Counter-clockwise rotation of the drill string and mandrel 12 engages the engagement pawl 83 with the locking member 80 (see FIG. 4) and moves the locking member counter-clockwise. This disengages the locking tabs 90 and 91 on the lock and the annular piston. In particular, after the locking member 80 is rotated about 30 degrees, it hits a stop 87 and then causes the housing 14 to rotate counter-clockwise.

Next, the mud pump is then turned on. When the fluid pressure builds up, it acts on the annular piston 60 (through pressure port 63), and the piston is driven up-hole. Anti-rotation tabs 70 on the housing 14 prevent the annular piston 60 from rotating relative to the axis of housing. As the piston 60 moves axially, the radial pin 67 extending from it drives into the sleeve recess 68, causing the cam sleeve 31 to rotate counter-clockwise to move the two pads 20 and 22 into the directional drilling position (see FIGS. 5B and 2A). Thus, each time it is desired to drill in the directional mode, the drill string is rotated counter-clockwise, with the mud pump not running, to disengage the lock activation 64 and to position the housing 14 (and its pads 20 and 22) in the desired orientation.

By means of the pressure vent port 65, the fluid pressure at the spring end of the piston 60 is controlled to be about equal to the annular pressure in the wellbore. The pressure acting on the activation or down-hole end 12D of the piston 60 is greater than the annular pressure at the exterior of the housing 14 by approximately the pressure drop across the drill bit. This provides sufficient pressure to activate the piston 60 without requiring more additional energy than would normally be used in drilling.

Next, the drill string is rotated clockwise. The torsional spring 82 then provides the force to move the activation lock 64 back into the locked position (see FIG. 3). Then, when the flow of drilling fluid is interrupted, the pressure force on the piston 60 is reduced, and the compression spring 62 causes the piston to move axially down-hole. When the lock tab 90 on the piston 60 hits the tab 91 on the locking member 80, their inclined surfaces cause the locking member to rotate counter-clockwise until the piston lock tab 90 is past the opposite locking tab 91. The locking member 80 then rotates clockwise (under the action of the torsion spring 82) and captures the piston 60 in the locked position until the next time it is intentionally unlocked by counter-clockwise rotation of the drill string. In this manner the cam sleeve 31 is automatically shifted into the straight drilling position when fluid flow is interrupted.

Using the annular piston 60 to rotate the cam sleeve 30 and extend and retract the active pads 20 and 22 provides a good mechanical advantage. When the cam sleeve 31 moves the blades about 0.25 inches by 30 degrees of sleeve rotation, about 1000 pounds of radial force on the blade can be generated with only 100 psi acting on a 0.25 inch wide annular piston (after taking into consideration that half the axial force will be taken up compressing the return spring). The piston 60 can easily be made wider than 0.25 inches and the available mud pressure will normally be greater than 100 psi. Thus, there should be no problem with having adequate energy to move the active blades 20 and 22.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made in the shape, materials, size and arrangement of parts. In particular, the invention may or may not use a flexible joint, depending on the curvature that is desired. The number of extending and fixed blades may be more or less than that described in the illustrated embodiment. The shifting mechanism may be located either up-hole or down-hole from the blade section of the housing. Alternate combinations of pressure activation and drill string rotation may be used to activate the cam sleeve. Moreover, the locking cam surfaces may be aligned axially so that they are activated by simple axial motion rather than rotational motion. Thus, it will be appreciated that various modifications, alternatives, variations, and changes may be made without departing from the spirit and scope of the invention as defined in the appended claims. It is, of course, intended to cover by the appended claims all such modifications involved within the scope of the claims.

I claim:

1. Apparatus, comprising:

a housing having at least one fixed stabilizer blade carried on the outer surface of said housing to keep said housing centered in the borehole in a first plane passing through the centerline of the borehole;

a rotatable mandrel passing through the interior of said housing, and adopted to be joined to a drill bit at one end of the mandrel and to a drill string at the opposite end of the mandrel;

a cam member that is carried by said mandrel and that is operated by drill string rotation and the flow of drilling fluid through the mandrel; and two extendible blades that are carried on said outer surface of said housing to move said housing through a second plane passing through the centerline of the borehole and an angle relative to said first plane, and that are mechanically supported on said cam member so that at any time one blade is extended the other blade is retracted.

2. The apparatus of claim 1, wherein said housing has two fixed stabilizer blades carried on its outer surface.

3. The apparatus of claim 1, wherein said two extendible blades are located on opposite sides of said housing.

4. The apparatus of claim 1, wherein said cam member comprises: a sleeve carried by said mandrel, and a piston located between said mandrel and said housing and operatively connected to said sleeve for changing axial movement of said piston to rotation of said sleeve.

5. The apparatus of claim 4, including a lock, carried by at least one of said mandrel and said housing, for releasably holding said piston in one position relative to said housing.

6. The apparatus of claim 5, wherein said lock comprises a member carried by said mandrel for angular rotation about said mandrel, and wherein said piston is restrained from angular rotation relative to said housing.

7. The apparatus of claim 4, wherein said piston has one end in fluid communication with the interior of said mandrel.

8. The apparatus of claim 7, wherein the opposite end of said piston is in fluid communication with the exterior of said housing.

9. The apparatus of claim 8, further including a spring carried by said housing for biasing said piston at one end of said housing.

10. The apparatus of claim 4, wherein said sleeve is mechanically connected to said piston.

11. The apparatus of claim 1, wherein said second plane is generally perpendicular to said first plane.

12. A drilling tool for use with a drill bit and a drilling string into which drilling fluid is pumped, comprising:

a housing having at least one stabilizer blade on the outer surface of said housing and a generally hollow interior;

a rotating mandrel passing through the interior of said housing, having a down-hole end that is adapted to be connected to a drill bit, and having an up-hole end that is adapted to be connected to a drill string;

extendible blade means located on said outer surface of said housing, for moving said housing relative to the centerline of the borehole formed by the drill bit; and a cam mechanism that is carried by at least one of said mandrel and said housing and that is operated by drill string rotation and the flow of drilling fluid therethrough, for operating said extendible blade means.

13. The drilling tool of claim 12, wherein said blade means comprises two extendible blades carried by said housing; and wherein said cam mechanism comprises a pair of cams, carried on the exterior of a sleeve that is carried by said mandrel, for extending one of said blades and at the same time retracting the other of said blades.

14. The drilling tool of claim 13, further including two stabilizer blades that are fixed in position on said outer surface of said housing.

15. The drilling tool of claim 12, wherein said cam mechanism comprises an annular piston that is located between said housing and said mandrel, that has one end in fluid communication with the interior of said drill string, that has an opposite end in fluid communication with the exterior of said drill string, and that is disposed for axial movement.

16. The drilling tool of claim 15, wherein said cam mechanism comprises lock means for releasably locking said piston at one end of said housing.

17. The drilling tool of claim 15, wherein said cam mechanism comprises a spring for biasing said piston to one end of said housing.

18. The drilling tool of claim 17, wherein said spring is sized to provide a biasing force that is overcome when said one end of said piston is supplied drilling fluid at nominal drilling pressure.

19. The drilling tool of claim 16, wherein said lock means comprises a locking member that is located on the exterior of said mandrel and that is mounted for rotation relative to said housing in response to rotation of said mandrel.

20. A drilling tool for use with a drill string into which drilling fluid is pumped, comprising:

a general cylindrical housing having a bore between its ends;

a mandrel rotatably passing through said bore of said housing, having a down-hole end adapted to be connected to a drill bit and having an up-hole end adapted to be connected to a drill string;

one extendible blade carried on the outer surface of said housing, for moving said housing in one direction through a plane that passes through the centerline of the borehole formed by the drill bit;

a second extendible blade carried on the outer surface of said housing, for moving said housing through said plane in an opposite direction;

cam means, that is carried by at least one of said mandrel and said housing and that is operated by drill string rotation and the flow of drilling fluid therethrough, for extending one of said extendible blades and at the same time retracting the other of said extendible blades; and lock means, operating in response to rotation of the drill string, for locking and unlocking the movement of said cam member.

21. The tool of claim 20, wherein said lock means operates in response to rotation of the drill string while said housing is held relatively fixed in position relative to the borehole by said extendible blades.

22. Curve drilling apparatus, comprising:

(a) a generally cylindrical housing having an outer surface, an axial bore passing therethrough, at least one fixed axially aligned pad along its outer surface and at least one axially aligned movable pad located along its outer surface, said movable pad having an extended position and a retracted position;

(b) a mandrel that is rotatably located in said bore of said housing that is adapted to be connected intermediate the ends of a drill string, and that has an interior bore for the passage of drilling fluid therethrough; and (c) operating means, carried by said housing and operated in response to the flow of fluid through said mandrel, for moving said movable pad between its two positions, said operating means comprising an annular piston that is carried between said mandrel and said housing that has one end in fluid communication with said bore of said mandrel and that has an opposite end in fluid communication with said outer surface of said housing.

23. The apparatus of claim 22, wherein said movable pad comprises a blade that is located in an exterior recess of said housing that has one side pivoted to said housing and that has an opposite free side; and wherein said operating means comprises a sleeve carried by said mandrel, operated by said annular piston and having at least one camming surface for engaging said blade and moving said free side outward to said extended position.

24. The apparatus of claim 23, wherein said piston is axially movable between a down-hole position and an up-hole position, and carries a radially disposed pin; wherein operating means comprises a spring for biasing said piston to said down-hole position; and wherein said sleeve has a groove therein that lies in a plane that is located at an angle to said axis of said mandrel and that is adapted to receive said pin such that axial movement of said piston induces rotation of said sleeve.

25. The apparatus of claim 24, further including (d) locking means, carried by said housing, for holding said piston in its down-hole position.

26. The apparatus of claim 25, wherein said down-hole end of said piston carries a locking tab; and wherein said locking means comprises a locking member that is rotatable relative to the axis of said bore between a locked position where said locking tab of said piston is engaged by said locking member and an unlocked position where said locking tab is disengaged.

27. The apparatus of claim 26, further including a spring for biasing said locking member to its locked position.

28. The apparatus of claim 26, further including camming means, carried by said mandrel and said locking member for rotating said locking member to its unlocked position in response to counter-clockwise rotation of said mandrel.

* * * * *